United States Patent [19]

Walton et al.

[11] 4,142,278

[45] Mar. 6, 1979

[54] COMPRESSIVE TREATMENT OF WEB MATERIALS

[75] Inventors: Richard R. Walton, 10 W. Hill Pl., Boston, Mass. 02114; George E. Munchbach, Roslindale, Mass.

[73] Assignee: Richard R. Walton, Boston, Mass.

[21] Appl. No.: 736,859

[22] Filed: Oct. 29, 1976

[51] Int. Cl.[2] ..... D06C 21/00

[52] U.S. Cl. ..... 26/18.6

[58] Field of Search ..... 26/1, 18.6, 21; 223/28; 264/282; 162/111, 280, 281; 28/1.6; 425/369

[56] References Cited

U.S. PATENT DOCUMENTS

| | | | |
|---|---|---|---|
| 1,411,656 | 4/1922 | Colley | 162/281 |
| 1,548,789 | 8/1925 | Lorenz | 162/282 |
| 1,582,839 | 4/1926 | Lorenz | 162/113 |
| 1,686,388 | 10/1928 | Lorenz | 162/113 |
| 1,690,411 | 11/1928 | Hudson | 162/281 |
| 1,751,471 | 3/1930 | Campbell | 162/280 |
| 1,762,157 | 6/1930 | Campbell | 162/281 |
| 1,978,407 | 10/1934 | Cadgene | 26/1 |
| 2,039,882 | 5/1936 | Cannity | 26/21 |
| 2,115,313 | 4/1938 | Matthew et al. | 28/1.6 |
| 2,263,712 | 11/1941 | Wrigley et al. | 26/18.6 |
| 2,409,997 | 10/1946 | Straubel | 425/337 |
| 2,820,278 | 1/1958 | Mariani et al. | 28/1.6 |
| 2,851,206 | 9/1958 | Guenther et al. | 223/28 |
| 2,958,608 | 11/1960 | Barnard | 428/141 |
| 3,260,778 | 7/1966 | Walton | 264/282 |
| 3,471,907 | 10/1969 | Beckers | 26/18.6 |
| 3,869,768 | 3/1975 | Walton et al. | 26/18.6 |

FOREIGN PATENT DOCUMENTS

| | | | |
|---|---|---|---|
| 127110 | 1/1902 | Fed. Rep. of Germany | 162/280 |
| 130463 | 5/1902 | Fed. Rep. of Germany | 26/21 |

*Primary Examiner*—Robert Mackey

[57] ABSTRACT

Improved machine and method for longitudinal compressive treatment of webs employing a two roll drive nip. Specially arranged initial parts of one or a pair of stationary retarding members are positioned at the exit side of the drive nip in the region of minor divergence of the roll surfaces to provide damming forces. The initial part of the retarding member, preferably a curved, resilient nipping element, is shaped to oppose the flow of the web. By its construction and position close to the line of centers of the rolls, it establishes a very compacted column extending upstream to an initial treatment point continually located in the drive nip, between the moving surfaces of the rolls. In this region, longitudinal compressive action occurs upon the web in a continuous and uniform manner, preferably with compensatory action in response to variations in the forces exerted by the compacted column of web. This compensatory action is provided by resilient deformation of a retarding member in the direction normal to the plane of the web, resilient adjustment movement of a retarding member in the direction away from the nip roll center line, and in some cases, by resilient response of the compacted material itself. The retarding members may accomplish their resilient movement by swinging about the roll axes and by moving longitudinally of the web flow path. The retarding member, or the leading member of a pair, preferably, in the start-up position, has its initial part located upstream of the running position.

45 Claims, 15 Drawing Figures

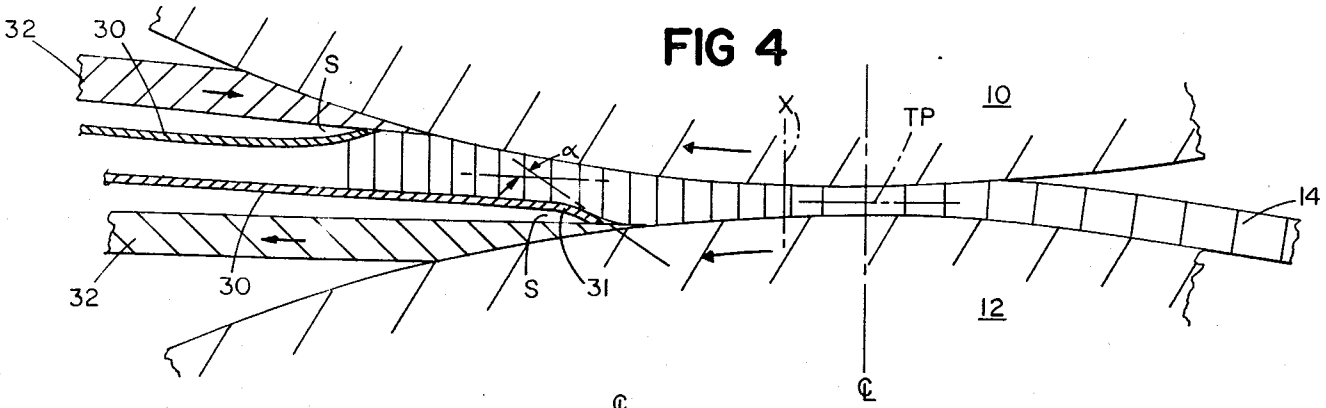
FIG 4
10
12
14
TP
X
31
α
S
30
32
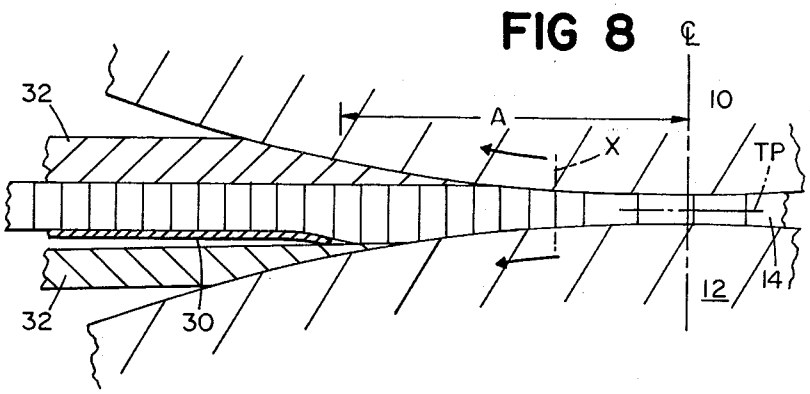
FIG 8
10
12
14
TP
X
A
30
32
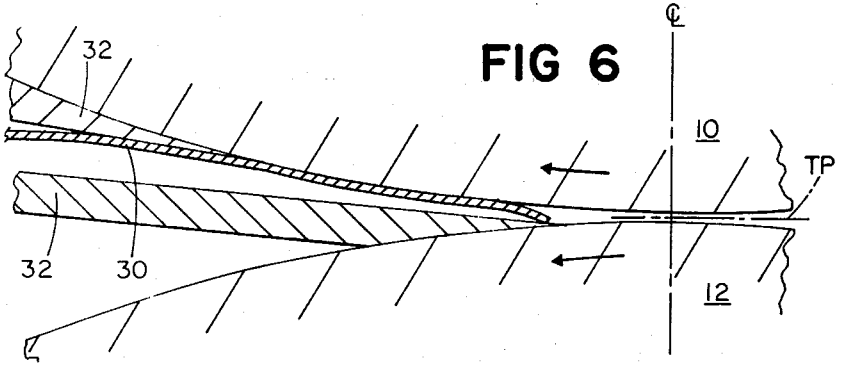
FIG 6
10
12
TP
30
32
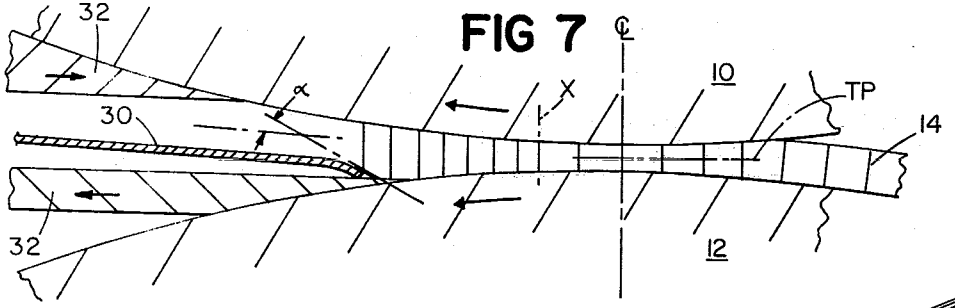
FIG 7
10
12
14
TP
X
α
30
32
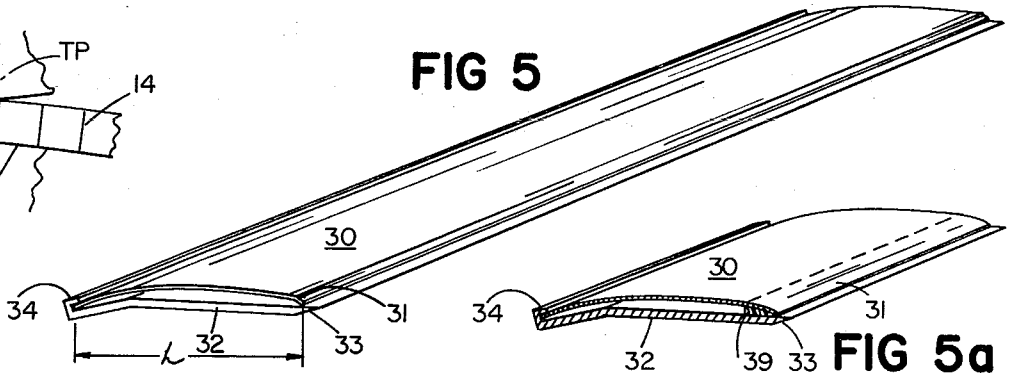
FIG 5
30
31
33
32
34
L
FIG 5a
30
31
33
39
32
34

14
TP
10
12
℄
M
M1
A
D1
20
17
D2
16
19
R

14
TP
10
12
℄
M
M1
X
20
17
21
18
16
19
R

14
TP
10
12
℄
M
M1
X
α
G
16
19
R

COMPRESSIVE TREATMENT OF WEB MATERIALS

BACKGROUND OF THE INVENTION

This invention relates to fine, uniform longitudinal compressive treatment of webs and web-form materials for changing their physical properties—treatments, for example, to provide shrink-resistance, stretchiness, increased density, softness, texture, improved filtering action, and other properties to textile and textile-like, including non-woven, web materials. Reference is made to prior art such as U.S. Pat. to Cluett No. 1,861,424; Wrigley et al. NO. 2,263,712; Barnard No. 2,958,608; Cohn et al. Nos. 3,015,145 and 3,015,146; Harmon No. 3,059,313 and the present inventor Walton Nos. 2,765,513; 2,765,514; 2,915,109; 3,260,778; 3,426,405; 3,810,280; 2,869,768; and 3,975,806.

Prior machines have been successful for many webs and end uses, but have still presented serious deficiencies in other important applications, producing, for example, unwanted differences in the two sides of a web being treated, or shear across the thickness of the material, or crushing of the material in the direction of the web thickness.

In the case of shrink-proofing tubular knit dyed goods using available machines, physical differences in the two sides, hence differences in the apparent color of the two sides, cause matching problems if apparel are made with the treated goods.

In the case of compressively treating loosely bound bats of filter fibers using available machines, unwanted crushing in the direction of the web thickness can detrimentally affect physical properties and the filtering action of the final product.

Prior machines have also presented problems in initial alignment of machine parts, in maintaining uniform settings throughout long production runs, and in the frequent need to replace parts subject to wear.

Many of the deficiencies of prior machines noted above are traceable to the manner in which the drive forces are applied to the web to be treated. In commercially successful machines the drive often involves a single roll and a stationary shoe which presses the web against the roll. While this is successful in providing drive force, it does so only while also providing certain shear and crushing forces. As has long been realized, if a machine could be provided for present purposes employing a pair of drive rolls forming a driving nip for the web, these deficiencies could be avoided or eliminated. The problem of doing this, however, is not simple because the kind of treatment being sought is one of extreme fineness, to be applied very uniformly over the web, without producing destructive action, lint, or unwanted folds or crepes. At the same time, the geometry provided by a pair of rolls is very limiting in respect to the space and manner of insertion of retarding members. With certain prior arrangements, it has been found that retarding blades and the like cut the material, or the material goes beneath the edge of the blade and becomes snagged. In other cases, the retarding members do not apply sufficient force to provide the fine, dense treatment desired, or spurting and uneven treatment, or detrimental gross folds or uwanted superficial crepe occur.

SUMMARY OF THE INVENTION

General objects of the invention are to overcome these and related deficiencies of the prior art, while certain particular objects are to provide a new compaction and shrink-proofing system for knitted goods, a new mechanical softening and compacting system for non-woven fabrics including those which are loosely formed, open or thick, and a new system for gathering, splaying and otherwise conditioning the fiber assemblage in a web or bat.

According to the invention, we have realized that the driving rolls, the retarding device, and the material being treated form a dynamic system, in which certain system parameters, if carefully observed, will result in the desired treatment. Specifically, we have established that for the fine treatments being sought, the treatment point at which the web is slowed down and cause to compact longitudinally must be maintained continually inside the actual drive nip, in opposition to forces presented by the moving drive surface bounding both sides of the treatment cavity. Secondly, the initial point of action of the stationary retarding device upon the extruding, compacted column must occur relatively abruptly as a damming force, at a position close to the initial point of compaction. This force is produced by a dam means capable of presenting a frontal surface inclined to the direction of the immediately approaching web, while downstream thereof the web is engaged by a surface lying relatively more parallel to the web direction.

For most cases, resilience should also be provided in the system, by which the compacting column, as it leaves the treatment point, and passes the initial point of the retarding device, engages the stationary surface of the retarding device in a resilient, supported manner, thus allowing for compensatory give and take as the compressive forces tend to rise and fall and at the same time ensuring against the production of unwanted gross folds or superficial crepe. The nature of the desired resilient engagement is determined both by the properties of the particular material being treated as well as by the machine elements. A stationary retarding member is usually preferred to provide the resilience, preferably a thin flexible spring member; but in certain special cases where the treated material presents a compacted column which tends by itself to blossom to greater thickness, sufficient resiliency is then provided by the compacted material itself. In maintaining the position of the point of treatment, variations in the balance between the various friction and drag forces and the nature of the constriction offered by the retarding device, affect the treatment. In certain preferred embodiments, two drive rolls are employed having the same surface friction characteristics, and driven at the same speed, and a pair of retarding members are advantageously employed, which in running condition, act in a balanced way upon the material.

In other preferred embodiments, a single retarding member may be employed which has a leading part supported next to a first of the rolls and a rearwardly extending part conforming to the curvature of the opposite roll, the latter roll preferably having a reduced driving force relative to the first roll. This reduced driving force may be provided by driving the opposite roll at a slower speed, or by providing a surface which is not as rough as that of the first roll. The balance of forces is also adjusted by providing surface roughness on the active surface of the retarding member as by plasma coating with an abrasive material.

In still other embodiments, a machine is provided with single retarding member operation, as for start-up, and means to provide a transition to double retarding member operation, during running conditions, as for achieving the uniform effects on both sides mentioned above.

According to one aspect, therefore, the invention concerns a machine and method for longitudinal compressive treatment of a web, in which the machine comprises a drive nip for driving the web along a web path, formed by a pair of rolls having stable surfaces, and a retarding system, on the exit side of the nip, formed by one or a pair of relatively stationary retarding members. The invention features, in such machine and method, the initial part of a stationary retarding member specially formed to provide damming forces to the web. This initial part is positioned immediately adjacent to the line of centers of the nip, to define a longitudinal compressive treatment cavity of correspondingly short length, in which a densely compacted column of web is produced and maintained. According to one aspect of the invention, this initial part is capable of presenting a frontal surface inclined to the approaching web and preferably, it retains this form as compacted web continually moves past. According to another aspect of the invention, this initial part is a resilient nipping surface, preferably a curved, resilient member presenting a convexly curved surface to the corresponding side of the advancing web, preferably the upstream end of this curved member converging toward the respective nip roll. In preferred embodiments, the dam surface lies at an angle of greater than 20° and less than 60° to the oncoming web, the dam is positioned downstream from the line of centers of the pair of rolls at a distance less than about 5% of the sum of the diameters of the rolls, and an elongated confinement surface extends downstream of the dam on both sides of the web enabling the web to be confined in compacted state for a period of time. In various preferred embodiments, means are provided to permit resilient compensatory motion of at least one of the retarding members to increase the cross-section of the web flow path in response to increase of compressional forces exerted by the compacted column, for instance, the dam or the curved resilient member is resiliently deformable in the direction normal to the surface of the web. Preferably, such a resiliently deformable member is of sheet metal spring form, e.g., of less than about 0.010 inch thickness, extending generally in the direction of the web path, preferably having an upstream end bent relatively abruptly toward the nip roll, preferably the rolls and the spring member extending continuously throughout the width of the web being treated. Preferably, a second member is interposed between the spring member and the respective roll, against which the spring member bears for support during the treatment, this second member preferably having an upstream portion adjacent to the roll, in advance of the upstream end of the spring member, against which the end of the spring member bears, and in the case of the preferred free-ended spring member, upon which the free end can slide during deflection.

Also, in preferred embodiments, at least one of the retarding members is mounted for resilient compensatory movement in a direction outwardly from the drive nip line of centers in response to increase in compressional force exerted thereupon by the compacted column, preferably the retarding member being mounted to swing about the roll to which it is adjacent to produce the compensatory movement. In various preferred embodiments, the retarding members are at least partially responsive to forces exerted thereupon to move in self-adjusting motion, in certain preferred embodiments to move oppositely, and the initial part of one of the retarding members in its starting position is located upstream of the initial part of the other retarding member, and adapted to move to a more nearly equal position as steady state running conditions are reached. In other embodiments, only a single such retarding member is employed. In either case advantageously the retarding member is formed from a sheet of spring metal which can conform to the curvature of the opposite roll.

Preferably, the rolls are of rigid material preventing localized deformation of the roll surfaces in the region of the dams or spring members and a first of the retarding members is provided with the mentioned dam or spring member and the second of the retarding members comprises a surface extending generally parallel to the web path or each of the retarding members is provided with a dam or spring member.

In cases where the web material has resilience in the direction of its thickness, in certain embodiments the dam is formed as an integral nose portion of a wear-resistant, rigid-surfaced, retarding member.

The featured method of treatment of the invention lies in providing and positioning the various surfaces and actions mentioned above in treating web materials.

The invention also features a mounting system for a pair of retarding members enabling starting and running conditions to be achieved in a self-adjusting abd self-balancing system, for better controlled operation.

BRIEF DESCRIPTION OF THE DRAWINGS

FIGS. 2 and 3 are views on a magnified scale of the elements of this embodiment that form the treatment cavity, shown in greater magnified scale respectively in starting and running positions, while FIG. 4 is a diagrammatic view illustrating action of the material in an intermediate position between the positions of FIGS. 2 and 3;

FIG. 5 is a perspective view of a retarding member of the embodiment while FIG. 5*a* shows an alternate construction;

FIGS. 6, 7, and 8 are views corresponding respectively to FIGS. 2, 4, and 3, illustrating a machine with a single spring retarding member;

FIG. 9 is a view similar to FIG. 2 of a machine employing a single retarding member while

DESCRIPTION OF THE PREFERRED EMBODIMENT

Figure 1:
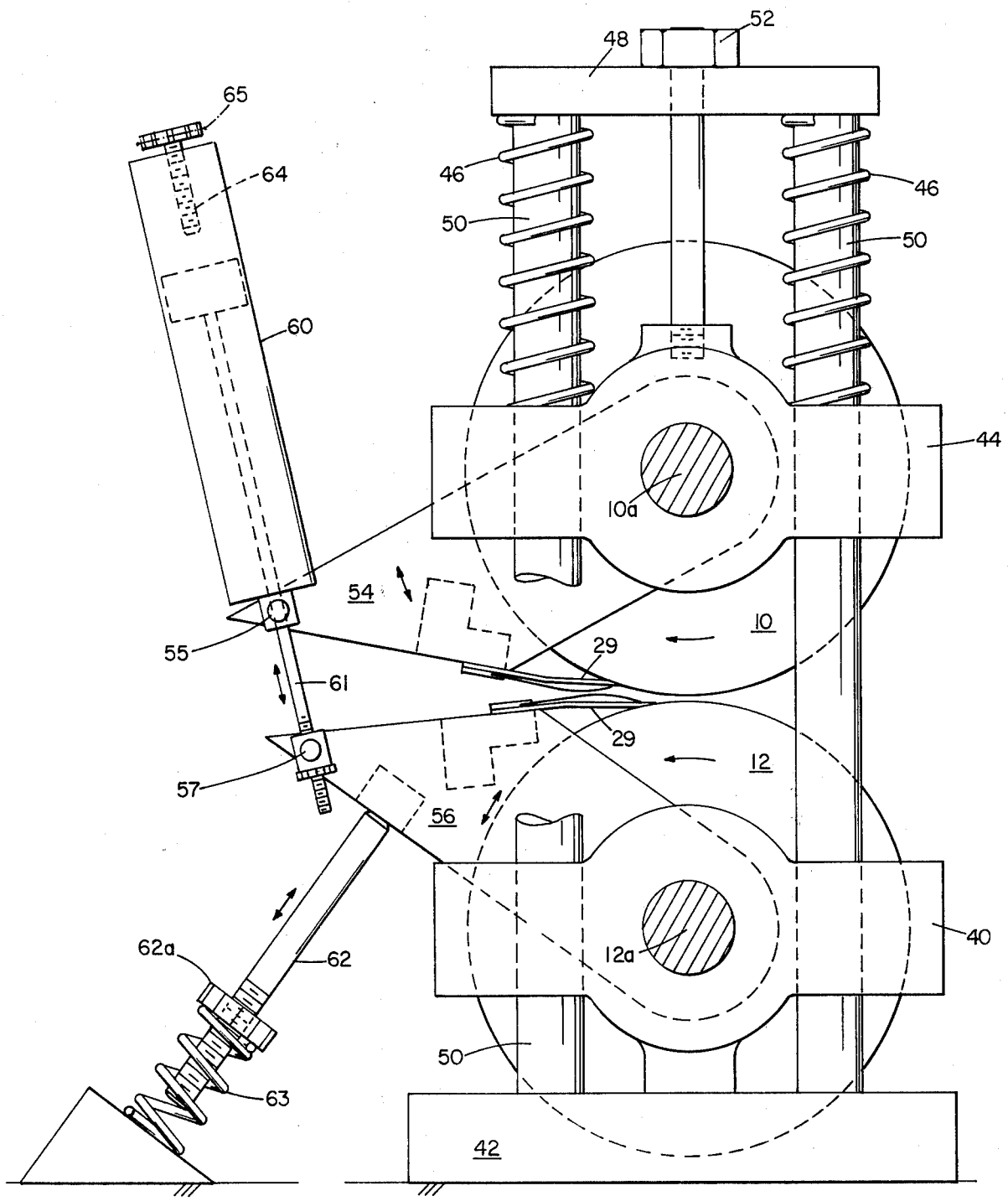
FIG. 1 is an end view of a machine assembly according to a preferred embodiment of the invention and FIG. 1*a* is a perspective view thereof.

Referring to FIG. 1, a preferred embodiment suitable as a wide-range laboratory or production machine is shown. Roll 12, e.g., of 5 inch diameter, is mounted in bearing 40 supported by base 42 and roll 10 also of 5 inch diameter is mounted in bearing 44 resiliently biased against roll 12 by compression spring 46 bearing against upper plate 48 held by rods 50 projecting from base 42. An adjustable stop 52 limits downward movement of roll 10 to establish the starting gap between the rolls. The rolls are of rigid material and are driven in the direction of the arrows by means not shown.

Retarding assembly arms 54 and 56 are pivoted about axes 10*a* and 12*a* at each end of the respective rolls, and upon each is mounted a retarding assembly 29, the details of which will be described later. Swinging the respective arm adjusts the retarding assembly about the periphery of the roll, maintaining a constant angular relation between the roll surface and the matching assembly.

Figure 1A:
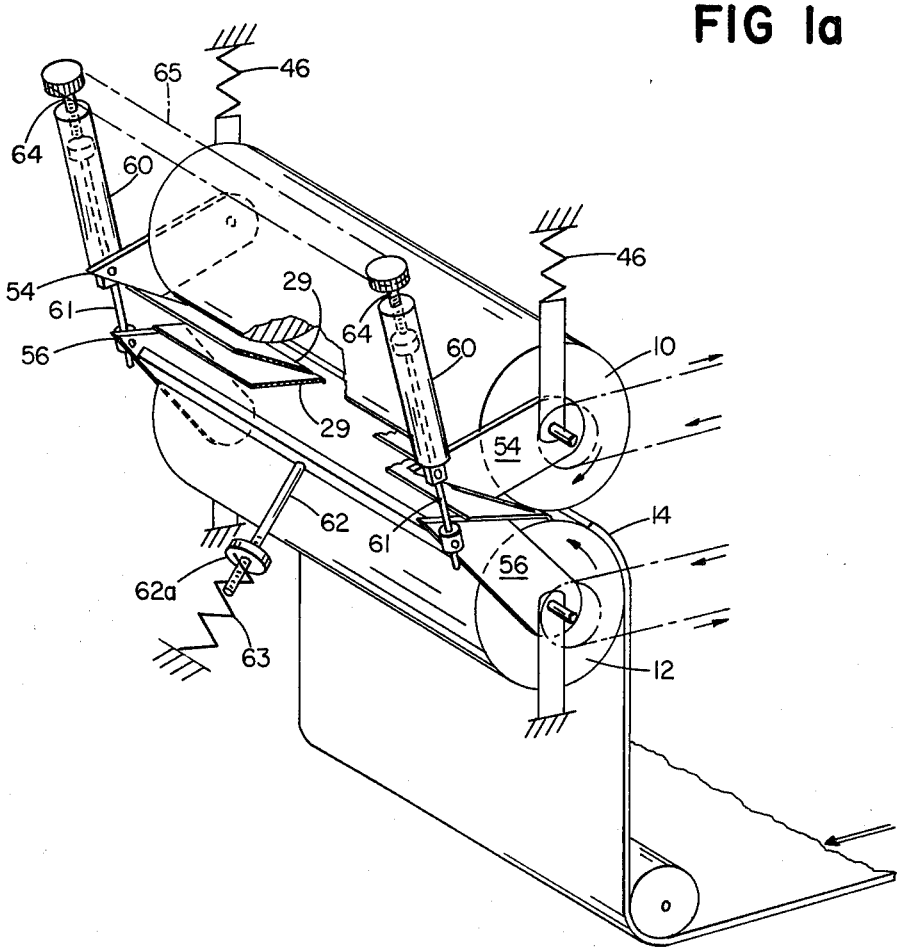

A double-acting air cylinder 60 is pivotally mounted upon upper arm 54 at 55 at each end of the machine and a rod extension 61 of the piston of each is pivotally connected at 57 to lower arm 56. Outward action of the piston forces arms 54 and 56 apart, causing rotation of the upper retarding assembly out of the nip, to the rest position shown in FIG. 1; inward action draws the upper assembly toward the minimum spaced working position established by stop 64. The stops for the two pistons are linked by a chain 65, FIG. 1*a*, to have equal movement during adjustment. The linkage provided by rods 61 ensures that if one retarding assembly moves out of the nip the other tends to move toward the nip. Adjustable lift rod 62, made resilient by spring 63, prevents gravity motion of the lower arm, thus making it possible to establish a position in which the lower retarding assembly 29 is inserted more deeply into the nip than the upper retarding assembly, with a predetermined amount of resilience.

For setup of the machine, without the web in place, roll stop nuts 52 at each end of the roll assembly are adjusted to establish the starting gap between the rolls, e.g., to a spacing equal to a fraction of the thickness of the particular web selected for treatment. Thereupon nut 62*a* of adjustable lift rod 62 is adjusted to impose a chosen degree of resilient compressive force with which lower retarding assembly 29 is lifted against gravity and urged into the nip. The stops 64 are then adjusted to establish the desired minimum spacing between the two assemblies, normally this spacing being smaller, the thinner are the materials and the finer the treatment desired. The air source for the air cylinder 60 can then be set, to establish the degree of resilient force tending to hold the two assemblies to the minimum spacing set by the stop 64.

For operation, with air pressure applied to air cylinder 60, arms 54 and 56 are drawn together, carrying the upper retarding assembly into the nip, the lower retarding assembly retaining approximately its original position. Thereupon the drive rolls are energized and the web is driven toward the retarding device, whose details will now be described.

In the embodiment of FIGS. 1–4 each of the retarding assemblies 29, see FIG. 5, is provided with an initial part forming a dam, realized in a two-part construction which incorporates a resilient compensatory action. Spring plate 30, e.g., a blued spring steel, is provided with a bent-down frontal curve, the end 31, converging toward its roll, and is mounted upon a carrier knife blade 32 having a leading part 33 which extends slightly upstream of the end 31 of plate 30. Both extend continuously for the full operative width of the machine, as do the rolls with which they are associated. The forward end 31 of the spring plate is free, but bears for support upon carrier blade 32. The opposite end, spaced downstream, is fixed in holder 34 (FIG. 5) attached to carrier blade 32.

As shown in this preferred embodiment, the frontal portion 31 of member 30 forms an acute angle $\alpha$ with the direction of the oncoming web path within the range of $\alpha$ greater than about 20° and less than about 60°. The web-contractable surface 35 of member 30 downstream of the frontal 31 forms an angle $\beta$ more closely parallel to direction D.

Figure 2:
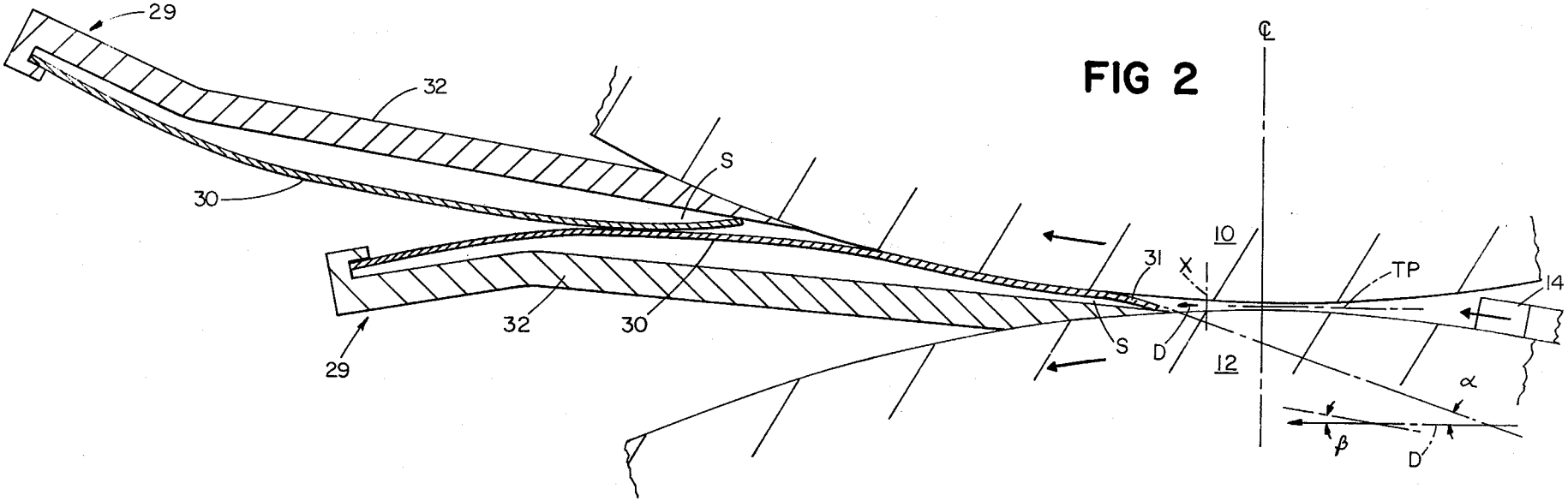

The operative sequence of the machine is as follows. After actuation of the air cylinder 60 draws the arms 54, 56 together, the position of FIG. 2 is attained. Note that the lead flexible retarding member 30 curves forward in conformity with the opposite roll 10 before terminating at the forward end 31 which curves toward the adjacent roll 12. As the web 14 is driven forward by the drive rolls, FIG. 2, it is opposed by the dam formed by the forward end 31 which has substantially filled the nip cavity. This resistance to the flow of the material causes a compacted column to extend upstream to point X, (See FIG. 4), close to the nip line of center ℄. As this occurs the lower retarding assembly 29, under the influence of the leftward compressive force of the material, moves toward the left, finally reaching the position shown in FIG. 3, compressing spring 63. Due to the linkage between the retarding member provided by pivoted rod 61, the upper assembly moves simultaneously upstream to the right from the position of FIG. 2 to that of FIG. 3. Depending upon the forces generated in the material, the resilient air pressure of the cylinder can be overcome to force both assemblies to the left of the position of FIG. 3 to further separate the assemblies. As the damming forces produced by spring member 30 oppose the passage of the material, compaction occurs in the nip, in the extremely short passage A between the retarding device and the nip line of centers ℄

The length of this passage is generally no more than about 5% of the sum of the diameters of the two rolls, and usually is less than half that amount. An open space S (FIG. 4) between the curved end 31 of spring member 30 and its associated carrier blade 32, enables each spring member 30 to resiliently deflect face-wise toward its blade 32 in the presence of the forces perpendicular to the plane of the web exerted by the compacted web. During this action the relatively abrupt curvature of the initial part of the spring member prevents its complete flattening. In this manner a damming quality can be retained during operation, in some cases the angle of the frontal surface desirably attentuated by resilient deflection of the upstream end of the spring member, as determined by the geometry and material of the spring and the forces exerted.

In another preferred embodiment, FIG. 5*a*, a resilient pad 39, e.g., of silicone rubber, extending the full width of the machine, adhered to the underside of the leading part 31 of the spring member 30, maintains angle of inclination $\alpha$ of the leading part during passage of compacted material. As the spring member 30 of either embodiment tends to deflect from its unstressed to its stressed, more flattened, position, its leading tip is free to slide upstream, while still bearing upon carrier blade 32, to facilitate this deflection. Also, downstream portions of the carrier blade serve to maintain the corresponding downstream portions 35 of members 30 in resilient contact with the compacted web, so that time-dependent processes can occur to set the treated web before it is released by further downstream movement. Opposition to any tendency of the column to spurt over the dam and shift the point X of initial compaction is assisted by this resilient engagement.

In a preferred embodiment the spring members are formed of 0.003 to 0.010 inch thickness blue steel sheet, bent generally with a radius of curvature of between four and five inches, and having a relatively abrupt bend toward the respective roll at a point ¼ to ⅛ inch from the upstream end of the spring member.

The mounting of these spring members as described permits them to work relatively to the passing compacted material and relatively to one another, even to vibrate, to aid in the smooth, low-friction passage of the compressed material between them.

Figure 3:
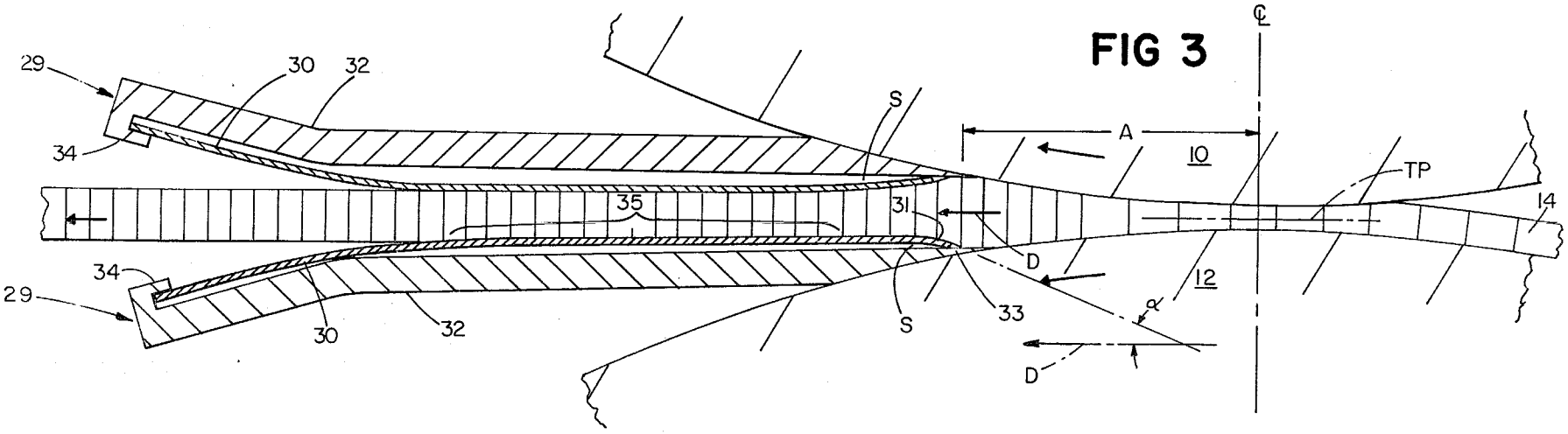

By comparison of FIGS. 2 and 3 it will be seen that the geometry of the treatment cavity is self-adjustable in yet another way between start-up and running conditions. The upper roll is resiliently deflected upwardly by the compressed material, thus self-adjustably lightening any crushing tendency commensurate with the continued compaction of the web, a motion revealing that fluid pressure-like compression forces are generated.

On the other hand it is of vital importance that the roll surfaces be stable, in many instances that they be entirely rigid, for by this feature the contour of the treatment cavity is stably maintained, and avoids any tendency for the compacted material to indent into the roll to move with it in spurts.

The embodiment just described is suitable for use with very thin materials, and with materials which are not resilient when compacted. It is particularly well suited in instances where identity of treatment of both sides of the web is an extreme requirement. In instances where such uniformity is not so vital, one of the retarding members may be positioned further ahead of the other, an arrangement which is also sometimes useful when very thin webs are to be treated.

Referring now to FIGS. 6–8 there is shown a double bladed retarding device. Only one of the blades carries a single spring member 30, which, as does the lead spring member in FIG. 2, dams the cavity at start-up, even to some extent resiliently conforming to the opposite roll as shown in FIG. 6. This lead retarding assembly moves from the start-up position of FIG. 6 through the intermediate position of FIG. 7 to the operating position of FIG. 8. This embodiment may be employed where identity of treatment of both sides of the material is of reduced concern, and in instances in which the web material itself demonstrates a certain degree of resiliency in the compacted state. Indeed it is found to give an acceptable uniformity of treatment to both sides of the web in many instances, with the virtue of requiring fewer parts than the embodiment of FIGS. 1–4.

Figure 9:
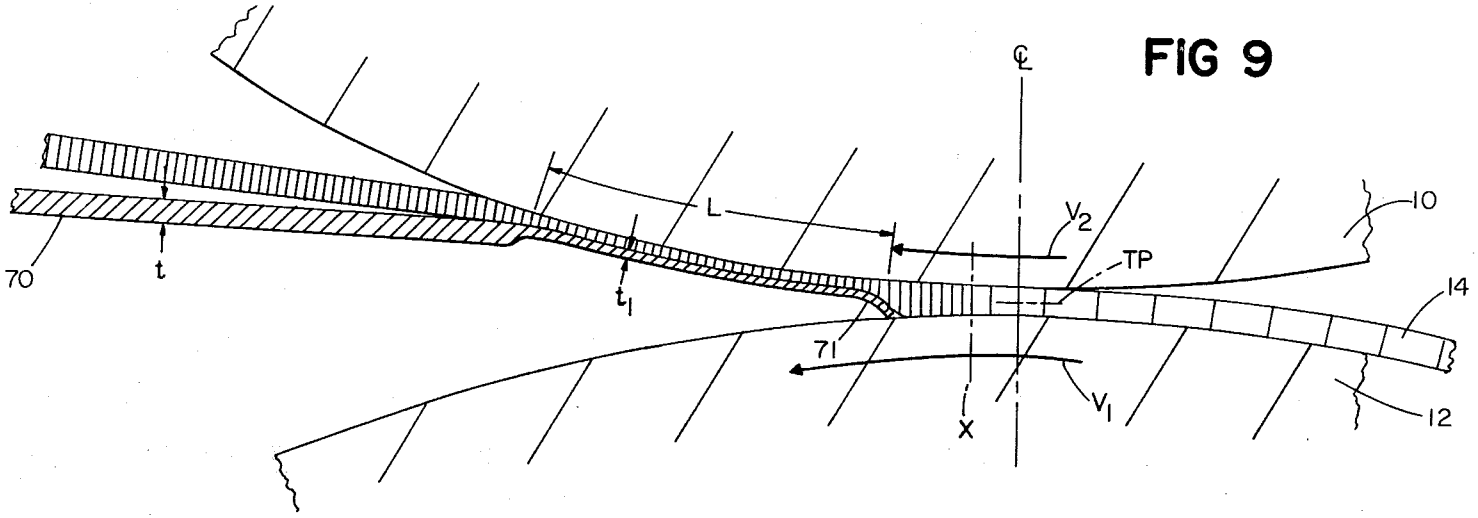
Figure 10:
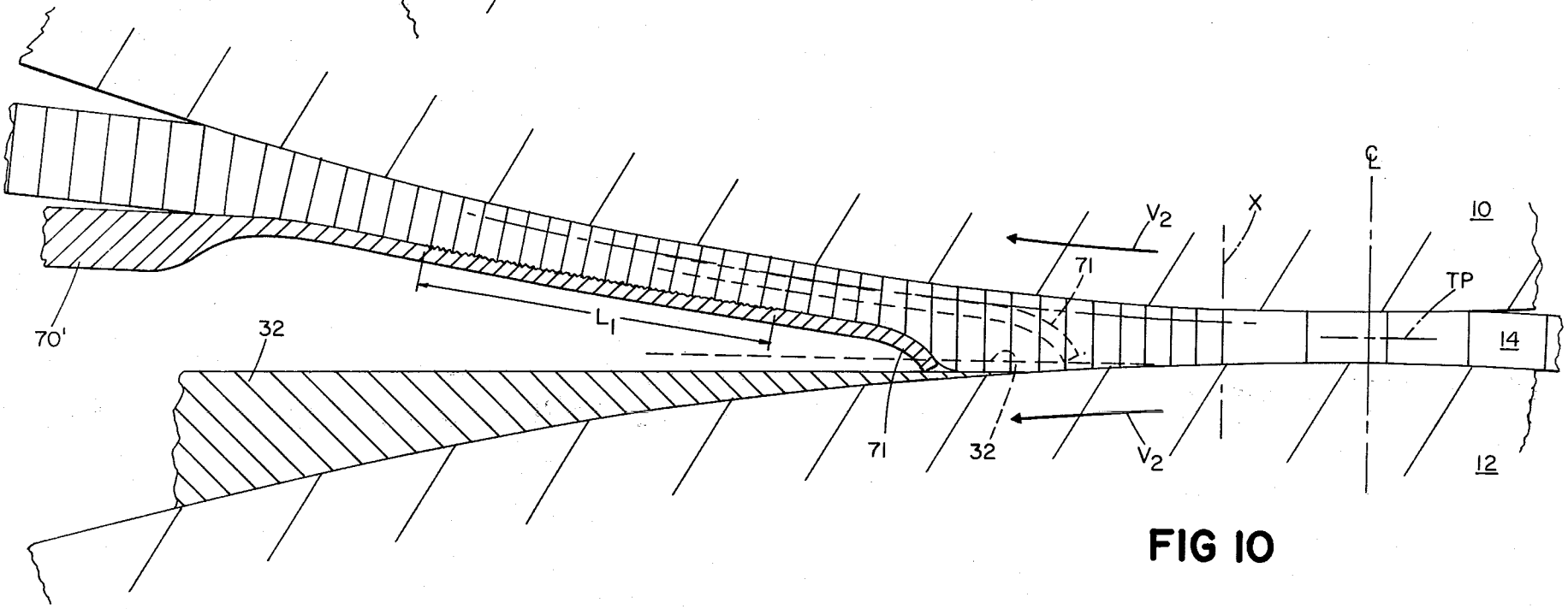
FIG. 10 is a view on an enlarged scale of a variation thereof.

Referring to FIG. 9, a two-roll machine is shown employing a single retarding member 70. This retarding member is formed of spring steel sheet, for instance of thickness $t = 0.010$ inch in its rearward portions. The forwardmost portion of length L of e.g., ½ inch, is of reduced thickness, i.e., $t_1 = 0.005$ inch. The rolls 10, 12 and the retarding member 70 extend continuously throughout the width of the material to be treated. The retarding member 70 is formed with a gradual longitudinal curvature upwardly convex in unstressed condition, throughout its thin portion, with a decreased radius curvatures at its forward tip 71. The member 70 is held in position in FIG. 9 with the curved tip 71 bearing directly against roll surface 12 and with the portion to the rear thereof conforming to the curvature of the opposite roll 10. As in the previous embodiments, the effect of the retarding member is to produce a compacted column of material extending to the right of the tip of the retarding member to point X, thus defining the treatment cavity within the nip, bound by the two moving rolls. In the embodiment shown, roll 12 is driven at a velocity $V_1$ while roll 10, which engages the compacted material over length L after compaction, is driven at the slower speed $V_2$. In this case both rolls 10 and 12 may be provided with a smooth surface finish such as chrome plate over steel. In the embodiment of FIG. 10, similar to FIG. 9, the rolls 10 and 12 are driven at the same velocity $V_1$ and the retarding member 70' has a band, extending over distance $L_1$, of roughened surface, i.e., a plasma coating of metalcarbide is applied to spring sheet member over this distance. In this embodiment rolls 10 and 12 may similarly be provided with the plasma coating to obtain a strong grip on the material. In another embodiment, roll 12 is provided with such a coating, but roll 10 is provided with a smoother surface. In both FIGS. 9 and 10 the retarding members are pictured in a running condition. The dotted line position in FIG. 10 represents the starting position in which the retarding member substantially fills the nip before the material is driven into contact with it.

Figure 11:
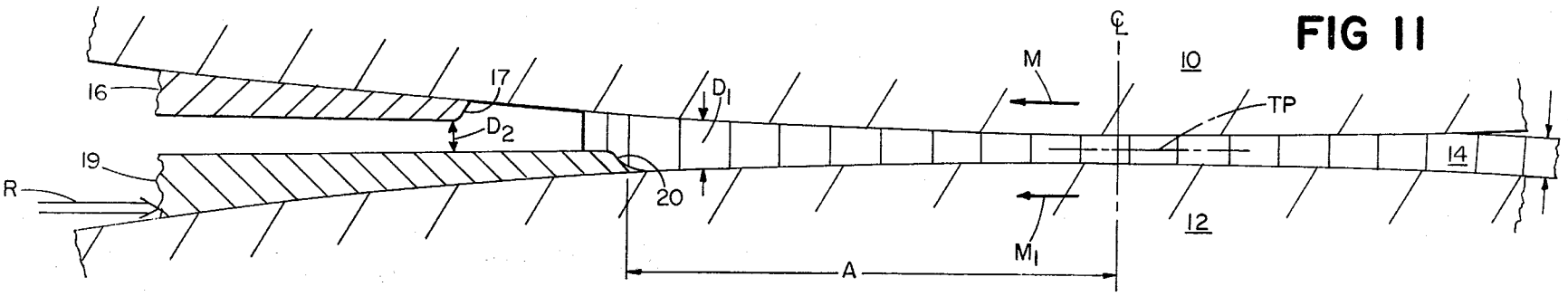
FIGS. 11–13 are views similar to FIGS. 6–8 of a machine employing rigid retarding faces.
Figure 12:
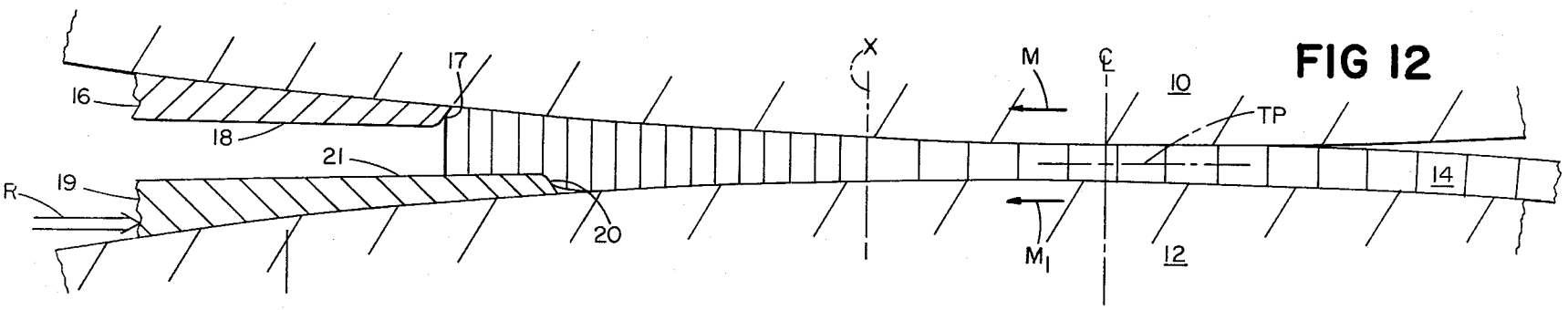
Figure 13:
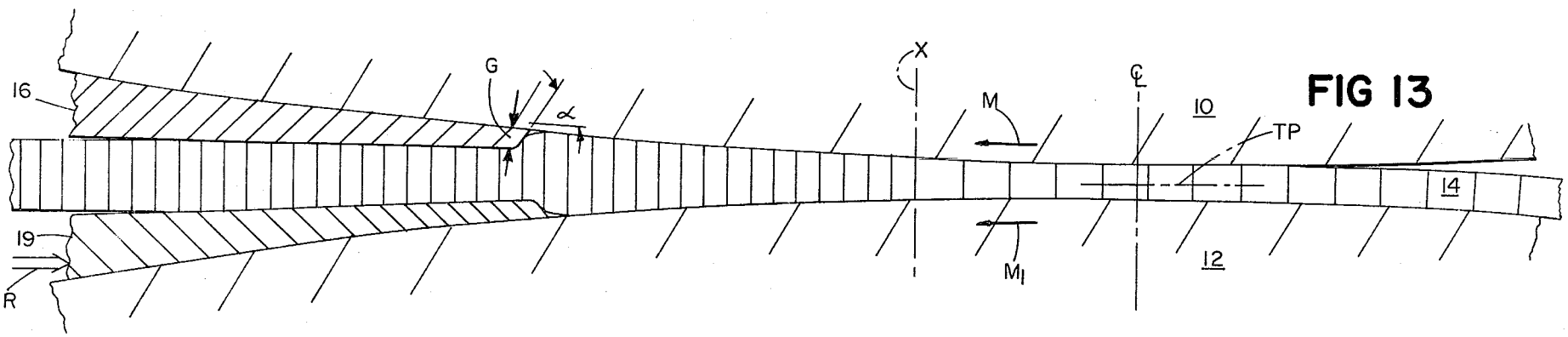

In the embodiments so far described the retarding device has been the source of resilient engagement with the compacted material. Referring to FIG. 11, 12, and 13, in other instances certain web materials, e.g., certain needled felts, offer sufficient resiliency that the material itself is the source of resilient compensatory action, in the presence of varying compressional forces.

Referring to FIG. 11, the paired drive rolls 10, 12 rotating per arrow M, $M_1$, drive web 14 between opposed stationary rigid surfaced retarding members 16, 19. These members are similar in general construction to blades 32 and may be mounted in similar fashion in the machine of FIG. 1, or the machine of FIG. 14, to be described later on. The retarding members 16, 19 have initial parts 17, 20 inclined to the direction of oncoming web, forming dams, positioned in the region of minor divergence of the rolls beyond the nip center line for frontally opposing the progress of the web.

The initial parts of the retarding members 16, 19 of FIGS. 11–13 are sloped and then rounded, progressing downstream, merging into flat surfaces 18, 21 which diverge gradually relative to the axis of the web path. With this form it will be seen that the passage for the material reduces in a short convergent passage from dimension $D_1$, between the moving drive rolls preceding the retarding device, to lesser dimension $D_2$ between the retarding members 16, 19, for abruptly applying retarding forces, and then expands to ease the flow of the treated material, as described above. While under certain circumstances the retarding members may be rigidly held, it is preferred that at least the leading retarding member 19 be mounted free to respond to forces exerted by the compacted material to move resiliently to the left from the initial position in FIG. 11, with the leading part 20 continually, during this movement, hugging the roll surface, opposed by a suitable spring restraining force denoted by double arrow R. For starting the treatment, the blunt part 20 of retarder 19 is positioned at distance A very close to the nip line, FIG. 11, and the action commences by frontal opposition to the web by the leading retarder 19 and movement to the position of FIG. 12. By the time the compacted material passes over the leading parts of both of the retarding members, the longitudinal forces increase sufficiently to force retarder 19 to the position of FIG. 13, with the size of the entrance between the members thus self-adjusted in a compensatory manner, and with the rolls spread apart in response to the compressive forces of the process.

Figure 14:
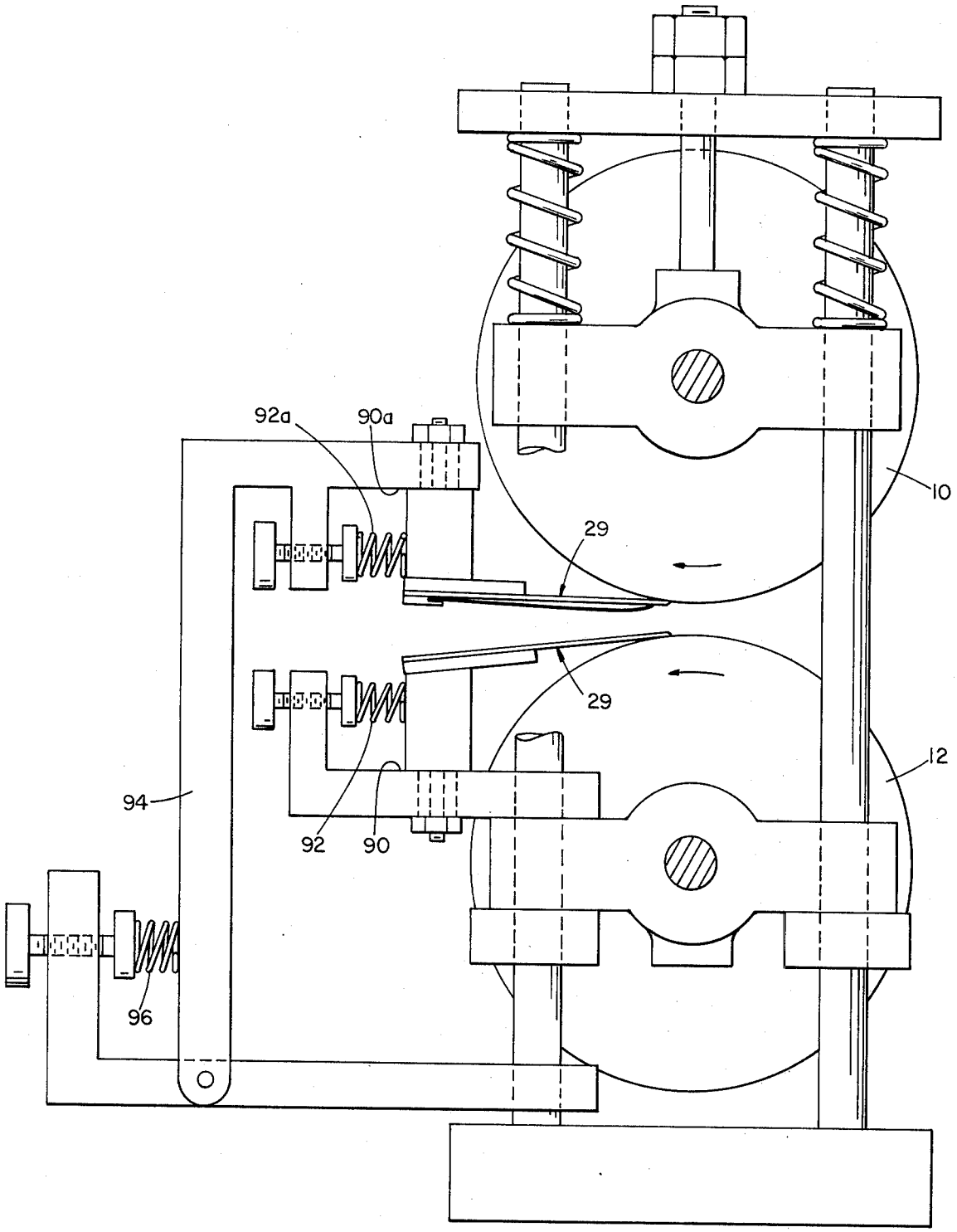
FIG. 14 is an end view similar to FIG. 1 of an embodiment employing linear adjustment of the retarding members.

It is found desirable that the compensatory motion of retarding member 19 have a degree of independence from the other retarding member, e.g., in certain cases it is advantageous that both members be resiliently mounted, e.g., by springs as shown in FIG. 14 or by pneumatic cylinders. Thus, retarding member 16 can be arranged to adjust by movement dependent upon the spring rate of its resilient mount.

In the embodiments of all of the figures, the drive rolls are advantageously provided with wear-resistant surfaces, for example, an external chrome layer or a plasma coating of a metal carbide over a steel base. Their surfaces may either be smooth or of a selected roughness, depending upon the driving forces employed and the nature of the treatment desired. The retarding members are also of suitable hard, wear-resistant material having polished surfaces in most cases.

In all of the preferred embodiments it will be understood that the retarding members in effect present a leading entry orifice which imposes the main restriction in a relatively resilient manner to the oncoming material, and in a way which prevents cutting or shearing by blades as the compressional forces build up, and this orifice shifts in position in a self-adjusting manner as the treatment establishes itself, all in the ways shown in the examples, to achieve extremely fine and controllable treatments.

While the swinging adjustment of the arms of the embodiment of FIG. 1 has advantage in maintaining the relationship of the retarding member tips to the rolls throughout the range of movement, other arrangements are possible. For instance, in the embodiment of FIG. 14 the lower retarding assembly 29 is mounted stationary (or on a linear slide 90, downstream movement being resiliently resisted by adjustably-positioned compression spring 92) while the leading part of the retarding assembly is resiliently biased to follow the contour of the roll surface. The upper retarding assembly 29 (optionally, similarly mounted on slide **90*a* and resisted by compression spring 92*a*) is mounted on elongated pivot arm 94, biased into the nip by compression spring 96**. (For purposes of illustration, the embodiment shows the upper roll held upwardly in a nonoperative position, and exaggerates the thickness of the members forming the retarding members.) The retarding members themselves may comprise any of the embodiments previously described.

Since the drive rolls are relatively smooth, the blades wil wear relatively slowly. In cases where wear does occur, blades can be simply replaced, or adjustment of the blades relative to their supports can be made to compensate for the wear. The blades may be insulated from their holders in order to assume the temperature of the machine, or of course separate heaters may be employed in cases where differential temperatures occur to remedy any distortion problems. The blade assemblies can provide steam, hot air or treatment gas distribution chambers, and the resilient blades can be perforated to admit such gases to the fabric both in the compression cavity in advance of the retarding assembly and in the retention passage following the retarding orifice.

To further explain operation according to the invention, during start-up, opposition by the dams or springs of the various retarding members causes the material to be retarded, see FIGS. 4, 7, 9, 10, and 11. Oncoming material is then longitudinally compacted in the confines of the diverging passage defined by the moving rolls, downstream of the nip center line ℄, and upstream of the retarding device. The retarding forces are thus transmitted upstream through a compacting column of web to a line x, at which the grip of the drive rolls on the material is first overcome. Further oncoming untreated material reaching line x slips relative to the drive rolls and is longitudinally compacted against the already compacted column, while the column is continuously forced to exit through the restricted region formed by the leading parts of the retarding members. The line x can shift to the right, toward the line of centers, if the compacted material forces the rolls apart from their original position. In any event, the retarding members are maintained in position such that the line x of initial compaction continually remains upstream from them, where the material is confined by the gradual diverging, moving roll surfaces as it is longitudinally compacted. The entire action upon the material thus occurs in essentially a straight line across the width of the web with both sides of the material exposed to respectively similar conditions during driving and retarding stages, and with only light crushing forces on the web perpendicular to the web plane.

In machines according to the invention, as previously mentioned, the distance over which the treatment actually occurs is very short. In preferred embodiments employing drive rolls both of 5 inch diameter, for instance, dimension A, from the nip line of centers to the initial part of the retarding device may be from 1/10 to ½ inch for a range of felt, non-woven, woven and knitted materials.

The surfaces of the retarding members downstream from their leading parts serve a retention function, being arranged to confine the material under a condition of partial release from face-wise constraint, but still under compression. Their retarding effect is minor while still time-dependent setting processes can occur. Depending upon the particular process involved, these passages may be subjected to heating or cooling conditions, or to steaming or to treatment with other fluids, as suggested above. The continuation of the retarding members outwardly therebeyond also serve as supports for properly positioning the active leading parts.

For reliable operation in most treatments, the resilient compensatory actions that have been described help to assure uniform flow and treatment, and to ensure positioning of the point of compaction continually in the nip, preceding the retarding device. But, as previously suggested, for instance with certain needled felts of e.g., ¼ to ⅜ inch uncompressed thickness, the material itself, when longitudinally compacted in the machine, still provides the needed resilience to resiliently compact or expand in the direction of its thickness as pressures respectively tend to rise or fall. In such cases an entirely rigid system may be employed.

The following are examples of cavity configurations operable according to the invention.

EXAMPLE I

A web has an uncompressed thickness of 0.032 inches and a nipped dimension of 0.012 inch at the center-line of the spring-biased 5 inch diameter rolls, under normal driving conditions. The two retarding members, constructed according to FIGS. 11–13, comprise steel plates of 0.050 inch thickness with ends hollow ground to match the curvature of the rolls, but each with a leading end portion formed in accordance with FIGS. 11–13, dimension G of 0.008 inch and angle $\alpha = 55°$. In the running condition, the ends of the retarding members are 0.16 and 0.25 inch from the line of centers, ℄, respectively. The dimension $D_1$ between the roll surfaces immediately preceding the retarding device is larger than dimension $D_2$, the minimum dimension between the retarding members.

EXAMPLE II

Similar to Example I, but with the construction of FIGS. 6–8, employing a convexly curved spring member 30 of 0.005 inch thickness blue steel, rounded with approximately 4 inch radius of curvature, and having its free tip approximately 1/16 inch to the rear of the tip of the blade 32 upon which it is mounted, as shown in FIG. 5. The curved spring member deflects to the position of FIGS. 7 and 8 during operation.

EXAMPLE III

A configuration according to FIGS. 2–4 in which the blade members 32 are each of at least 0.020 inch thickness, mild steel, with tips hollow ground to points as shown, matching the roll curvature. Spring members 30 of 0.003 inch thickness, blue steel, each have a distinct downwardly curved end, with sharp curvature beginning at a point about 3/16 inch from their free tips. With this arrangement, at startup, the parts may be forced into the nip in accordance with the position of FIG. 2, virtually filling the nip with metal and ensuring that flow of even the thinnest web will be opposed to commence and maintain the compactive action as described.

For treating such materials as tubular knitted webs, the parameters determining the resilient compensatory action are selected to maintain the roll surfaces and the retarding members in intimate supporting contact with the faces of the fabric, supporting the fabric against creping throughout its transit through the machine. For treating double layer materials, the machine surfaces can be adjusted to engage the material identically on both sides to ensure equality of treatment. In cases such as these, the relationship of the parts ensures that the material, even at start-up, never escapes past the leading portion of the retarding assembly without being compacted. The material is confined by the gently diverging hard surfaces of the rolls while the retarding members perform their damming opposition function to create and maintain the compacted column. The column, because of its shortness and denseness, and the preferred angular relationship of the dams, has the ability to bridge the transition between moving and stationary surfaces at both faces of the web without detrimental snagging, and the material proceeds throughout the machine while intimately engaged and supported on both sides. By this means a micro-treatment, without production of gross folds or detrimental crepe, is obtainable.

For treating loosely formed bats of webs, such as filter media, the drive rolls can engage the web only with sufficient force to thrust the material forward without undue crushing of the web in the direction of its thickness. In such a case, the machine surfaces may be relaxed to a position to produce a desired crepe of the material to re-orient the fibers as desired, while still the initial compaction proceeds in advance of the retarding device, in the manner described.

One aspect of the invention concerns the realization that, for very fine treatments, especially with materials difficult to treat, the start-up position and running positions cannot be the same. The invention provides a self-adjusting mechanism that achieves the proper geometry through the various stages.

Suitable variations of the parameters of the machine will be readily determined for a wide variety of webs and end uses in light of the foregoing disclosure.

What we claim is:

1. In a machine for longitudinal compressive treatment of a web, comprising a drive nip for driving the web along a web path formed by stable surfaces of a pair of oppositely rotating rolls, and a retarding device on the exit side of the nip, formed by at least one relatively stationary retarding member held next to a given roll, the improvement wherein the initial part of said retarding member defines means providing damming forces, said dam means being resilient in the direction normal to the plane of tangency defined by the two rolls at their nip to provide a resilient nipping surface inclined to the direction of web travel, downstream thereof said retarding member defining a material-engaging surface lying relatively more parallel to said web direction, said dam means constructed to enable continual flow of the web thereover while imposing resistance to said flow, and said dam means shaped to be positioned in the region of minor divergence of said roll surfaces downstream from the line of centers of said pair of rolls at a distance less than about 5% of the sum of the diameters of said rolls, to terminate therebetween a longitudinal compression cavity of correspondingly short length and height, means for continually maintaining said dam means at said position for steady state running conditions, said dam means thereby cooperative with the adjacent surfaces of said drive rolls to continually maintain in position in advance of said dam means, between the moving surfaces of said two rolls, a longitudinally compacted moving column of web against which fresh web delivered by said drive nip is progressively compressed, said roll surfaces at said cavity effective to continually intimately contact the faces of the web, to support the web against folding upon itself, whereby said web remains continually within its original general plane without gross pleating throughout its longitudinal compressive treatment and said resilient nipping surface effective to enable resilient accommodation of said column as it moves past said dam means while said dam means at a steady position relative to said line of centers.

2. The machine of claim 1 wherein the initial part of said retarding member presents a resilient material-engaging surface which, in unstressed condition, is convexly curved in the direction of travel of said web, shaped to enable continual flow of the web thereover while imposing resistance to said flow.

3. The machine of claim 2 wherein said retarding member, at least in its forwardmost position, has a portion downstream of said resilient nipping surface which conforms to the curvature of the roll opposite to said given roll, forming a passage for treated material therebetween.

4. The machine of claim 3 wherein said retarding member comprises a sheet metal member having a rearward portion of a thickness sufficient to provide stiffness against bowing under the influence of said compressed material and having a forward portion of relatively reduced thickness conforming to the curvature of said opposite roll.

5. The machine of claim 1 wherein said retarding member is a spring of sheet metal form extending generally in the direction of the web path and having an upstream end converging toward the respective nip roll.

6. The machine of claim 5 wherein said rolls and said resilient sheet metal spring member extend continuously throughout the width of the web being treated.

7. The machine of claim 5 wherein a second member is interposed between said sheet metal spring member and the respective roll, said second member having an initial upstream portion adjacent to said roll, in advance of the upstream end of said sheet metal spring member, against which said end bears.

8. The machine of claim 7 wherein said upstream end of said sheet metal spring member is free to slide upon the initial portion of said second member during resilient facewise deflection of said spring member.

9. The machine of claim 1 including means defining a said resilient nipping surface at both sides of the web.

10. The machine of claim 1 wherein said rolls are of such rigid material as to prevent any localized deformation of the roll surface in the region of said dam means.

11. The machine of claim 1 wherein said retarding device on the exit side of the nip is formed by a single relatively stationary retarding member held next to a given roll, and the initial part of said retarding member comprises means defining a resilient nipping surface cooperative with adjacent surfaces of said drive rolls to maintain in position in advance of said retarding device said longitudinally compacted moving column of web against which fresh web is progressively compressed, and wherein said retarding member has a portion downstream of said initial part which generally conforms to the curvature of the roll opposite to said given roll, forming a passage for treated material therebetween.

12. The machine of claim 11 wherein said opposite roll has reduced web drive capability relative to said given roll.

13. The machine of claim 11 wherein said opposite roll has a smoother surface than said given roll.

14. The machine of claim 11 wherein said opposite roll is driven at speed slower than said given roll.

15. The machine of claim 11 wherein said conforming portion of said retarding member comprises a roughened surface for imposing drag upon the compressed web passing thereover.

16. The machine of claim 1 wherein means biases a said retarding member defining said dam means into said nip, stopped by resistance provided by an opposite web-contactable surface of said machine.

17. The machine of claim 16 wherein said retarding member includes a resilient spring member which is stopped by the opposite roll.

18. The machine of claim 1 wherein said retarding member is mounted for resilient compensatory movement outwardly from said drive nip line of centers in response to increase in compressional force exerted thereupon by said compacted column, thereby to enlarge the cavity preceding said retarding member, to alter the steady state running position.

19. The machine of claim 18 wherein said retarding member is mounted to swing about the roll to which it is adjacent to produce said compensatory movement.

20. The machine of claim 1 wherein said dam means is defined by a resilient member of sheet metal spring form extending generally in the direction of the web path and having an upstream end bent relatively abruptly toward the respective nip roll to define said frontal surface both during initial approach of said web to said dam means, and thereafter, while compacted web moves continually over said dam means.

21. The machine of claim 1 including elongated confinement surface means extending downstream of said dam means enabling said web to be confined in compacted state for a period of time following its passage in compacted state over said dam means.

22. In a machine for longitudinal compressive treatment of a web, comprising a drive nip for driving the web along a web path formed by stable surfaces of a pair of oppositely rotating rolls, and a retarding device on the exit side of the nip, the improvement wherein said retarding device is formed by a pair of relatively stationary retarding members between which the web is pushed by the nip, said pair of retarding members having substantially parallel opposed web-contacting surfaces defining a retarding path aligned with the plane of tangency defined by the two rolls at their nip, said surfaces positioned to support the faces of said web to prevent gross pleating, the initial part of at least one of said retarding members defining a dam means, said dam means capable of presenting a frontal surface inclined to the direction of web travel immediately as it approaches said dam means, said dam means constructed to enable continual flow of the web thereover while imposing resistance to said flow, and said dam means shaped to be positioned in the region of minor divergence of said roll surfaces downstream from the line of centers of said pair of rolls at a distance less than about 5% of the sum of the diameters of said rolls, to terminate therebetween a longitudinal compression cavity of correspondingly short length and height, means for continually maintaining said dam means at said position for steady state running conditions, said dam means cooperative with the adjacent surfaces of said drive rolls and the opposite retarding member to continually maintain in position in advance of said dam means, between the moving surfaces of said two rolls, a longitudinally compacted moving column of web against which fresh web delivered by said nip is progressively compressed, said roll surfaces at said cavity effective to continually intimately contact the faces of the web, to support the web against folding upon itself, whereby said web remains continually within its original general plane without gross pleating throughout its longitudinal compressive treatment.

23. The machine of claim 22 wherein said retarding members are at least partially responsive to forces exerted thereupon by compressed material to move in self-adjusting motion to vary the relative position of the initial parts of said retarding members from a start-up to a steady-state running position.

24. The machine of claim 22 wherein said retarding members are connected together for dependent opposite movement from a first position in which one retarding member has its leading edge immediately adjacent to the line of centers of said pair of rolls and that of the other is spaced a greater distance from said line of centers, to a second position in which the said spacings of said retarding members are more nearly equal.

25. The machine of claim 24 wherein each of said retarding members is rotatably mounted about its respective roll and a linkage interconnecting said retarding members causing rotation of a first retarding member away from said line of centers causes dependent rotation of the second member toward said line of centers.

26. The machine of claim 25 wherein said linkage comprises a pivotal connecting rod extending between said retarding members.

27. In a machine for longitudinal compressive treatment of a web, comprising a drive nip for driving the web along a web path formed by stable surfaces of a pair of oppositely rotating rolls, and a retarding device on the exit side of the nip, formed by at least one relatively stationary retarding member held next to a given roll, the improvement wherein the initial part of said retarding member, for providing damming forces, defines a resilient nipping surface which is resilient in the direction normal to the plane of tangency defined by the two rolls at their nip, said nipping surface constructed to enable continual flow of the web thereover while imposing resistance to said flow, and said nipping surface shaped to be positioned in the region of minor divergence of said roll surfaces downstream from the line of centers of said pair of rolls at a distance less than about 5% of the sum of the diameters of said rolls, to terminate therebetween a longitudinal compression cavity of correspondingly short length and height, means for continually maintaining said nipping surface at said position for steady state running conditions, said nipping surface thereby cooperative with the adjacent surfaces of said drive rolls to continually maintain in position in advance of said nipping surface, between the moving surfaces of said two rolls, a longitudinally compacted moving column of web against which fresh web delivered by said nip is progressively compressed, said roll surfaces at said cavity effective to continually intimately contact the faces of the web, to support the web against folding upon itself, whereby said web remains continually within its original general plane without gross pleating throughout its longitudinal compressive treatment, and said resilient nipping surface effective to enable resilient accomodation of said column as it moves past said nipping surface while said nipping surface remains at a steady position relative to said line of centers.

28. The machine of claim 27 wherein said retarding member is a spring of sheet metal form extending generally in the direction of the web path and having an upstream end converging toward the respective nip roll, the curvature of the leading part of said metal sheet being relatively abrupt toward said given roll defining, in unstressed condition, a dam surface forming an angle between about 20° and 60° with the direction of the web passage immediately preceding said retarding member.

29. The machine of claim 27 wherein said retarding member is a spring of sheet metal form extending generally in the direction of the web path and having an upstream end converging toward the respective nip roll, the curvature of the leading part of said metal sheet being relatively abrupt toward said given roll defining, in unstressed condition, a dam surface and a resilient support pad disposed under the leading part of said sheet member to maintain frontal opposition by said leading part to oncoming web in the presence of compressional forces exerted by compacted web.

30. The machine of claim 27 wherein said retarding device on the exit side of the nip is formed by a pair of relatively stationary retarding members between which the web is pushed by the nip, the initial part of at least one of said retarding members defining a said resilient nipping surface said resilient nipping surface cooperative with the adjacent surfaces of said drive rolls and the opposite retarding member to continually maintain in position in advance of said resilient nipping surface, between the moving surfaces of said two rolls, a longitudinally compacted moving column of web against which fresh web delivered by said nip is progressively compressed.

31. In a machine for longitudinal compressive treatment of a web, comprising a drive nip for driving the web along a web path formed by stable surfaces of a pair of oppositely rotating rolls, and a retarding device on the exit side of the nip, formed by at least one relatively stationary retarding member held next to a given roll, the improvement wherein the initial part of said retarding member defines means providing damming forces, said dam means being resilient in the direction normal to the plane of tangency defined by the two rolls at their nip to provide a resilient nipping surface inclined to the direction of web travel, downstream thereof said retarding member defining a material-engaging surface lying relatively more parallel to said web direction, said dam means constructed to enable continual flow of the web thereover while imposing resistance to said flow, said dam means positioned adjacent to the line of centers of said nip to terminate therebetween a longitudinal compression cavity of correspondingly short length, said dam means thereby cooperative with the adjacent surfaces of said drive rolls to continually maintain in position in advance of said dam means, between the moving surfaces of said two rolls, a longitudinally compacted moving column of web against which fresh web delivered by said nip is progressively compressed, said dam means comprising a resilient spring member terminating at a free end directed upstream relative to the moving web, the terminal part of said spring element curving upstream from a direction generally parallel to the plane of tangency defined by the two rolls at the nip to a direction at said free end forming an acute angle $\alpha$ therewith, in a manner converging upstream toward the surface of said given roll that lies on the respective side of the web.

32. The machine of claim 31 wherein a second member is interposed between said spring member and the respective roll, said second member having an initial upstream portion adjacent to said roll, in advance of the upstream end of said spring member, against which said curved end bears.

33. The machine of claim 32 wherein said upstream end of said spring member is free to slide upon the initial portion of said second member during resilient facewise deflection of said spring member.

34. The machine of claim 31 including means defining a said resilient spring dam means at both sides of the web.

35. The machine of claim 31 wherein said retarding member, at least in its forwardmost position, has a portion downstream of said free end of said spring member which conforms to the curvature of the roll opposite to said given roll, forming a passage for treated material therebetween.

36. The machine of claim 35 wherein said retarding member comprises a sheet metal member having a rearward portion of a thickness sufficient to provide stiffness against bowing under the influence of said compressed material and having a forward portion of relatively reduced thickness conforming to the curvature of said opposite roll.

37. In a machine for longitudinal compressive treatment of a web, comprising a drive nip for driving the web along a web path formed by stable surfaces of a pair of oppositely rotating rolls, and a retarding device on the exit side of the nip, formed by a pair of relatively stationary retarding members each held next to a respective roll, and between which the web is pushed by the nip, the improvement wherein the initial part of at least one of said retarding members defines a dam means for providing damming forces, said dam means capable of presenting a frontal surface inclined to the direction of web travel immediately as it approaches said dam means and downstream thereof said retarding member defines a material-engaging surface lying relatively more parallel to said web direction, said dam means constructed to enable continual flow of the web thereover while imposing resistance to said flow, said dam means positioned adjacent to the line of centers of said nip to terminate therebetween a longitudinal compression cavity of correspondingly short length, said dam means cooperative with the adjacent surfaces of said drive rolls and the opposite retarding member to continually maintain in position in advance of said dam means, between the moving surfaces of said two rolls, a longitudinally compacted moving column of web against which fresh web delivered by said nip is progressively compressed, said retarding members being connected together for dependent opposite movement from a first position in which one retarding member has its leading edge immediately adjacent to the line of centers of said pair of rolls and that of the other is spaced a greater distance from said line of centers, whereby the nip defined by said rolls is substantially filled by said retarding members to a second position in which the said spacings of said retarding members are more nearly equal.

38. The machine of claim 37 wherein each of said retarding members is rotatably mounted about its respective roll and a linkage interconnecting said retarding members causing rotation of a first retarding member away from said line of centers causes dependent rotation of the second retarding member toward said line of centers.

39. The machine of claim 38 wherein said linkage comprises a pivotal connecting rod extending between said retarding members.

40. In a method of longitudinal compressive treatment of a webb, comprising driving the web forward along a web path by a pair of oppositely rotating, stable-surfaced rolls forming a nip, and retarding the web on the exit side of the nip by the positioning of at least one relatively stationary retarding member held next to a given roll, the improvement comprising opposing the flow of the web from the nip by a dam means on the initial part of said retarding member providing damming forces, said dam means capable of presenting a frontal surface inclined to the direction of said web travel immediately approaching said dam means, and engaging the web downstream thereof with a web-engaging surface lying relatively more parallel to said web direction, said dam means enabling continual flow of the web thereover while imposing resistance to said flow, the position of said dam means being maintained in a steady state running position in the region of minor divergence of said roll surfaces downstream from the line of centers of said pair of rolls at a distance less than about 5% of the sum of the diameters of said rolls, to terminate therebetween a longitudinal compression cavity of correspondingly short length and height, said dam means cooperating with the adjacent surfaces of said drive rolls to continually maintain in position in advance of said dam means, between the moving surface of said two rolls, a longitudinally compacted moving column of web against which fresh web delivered by said nip is progressively compressed, said roll surfaces at said cavity effective to continually intimately contact the faces of the web, to support the web against folding upon itself, whereby said web remains continually within its original general plane without gross pleating throughout its longitudinal compressive treatment.

41. The method of claim 40 wherein the flow of the web from the drive nip is opposed by nipping the web with a resilient retarding surface positioned adjacent to the line of centers of said drive nip.

42. The method of claim 41 wherein said flow of the web is opposed at least at one side by a resilient material-engaging surface which, in unstressed condition, is convexly curved in the direction of travel of said web, shaped to enable continual flow of the web thereover while imposing resistance to said flow.

43. The method of claim 40 including providing resilient compensatory motion of said retarding member to increase the cross-section of the web flow path in the region of said dam means in response to increase of compressional forces exerted by said compacted column.

44. The method of claim 43 including providing said motion resiliently in the direction normal to the surface of said web to produce said compensatory motion.

45. The method of claim 43 including providing said motion resiliently in a direction generally outwardly from the line of centers of said nip rolls.

* * * * *

UNITED STATES PATENT AND TRADEMARK OFFICE

CERTIFICATE OF CORRECTION

PATENT NO. : 4,142,278

DATED : March 6, 1979

INVENTOR(S) : Richard R. Walton

It is certified that error appears in the above-identified patent and that said Letters Patent are hereby corrected as shown below:

Col. 1, line 14 "NO." should be --No.--

Col. 2, line 18 "cause" should be --caused--

Col. 4, line 34 "abd" should be --and--

Col. 5, line 2 "spring" should be --springs--

Col. 5, line 47 "air source" should be --air pressure source--

Col. 6, line 10 "frontal 31" should be --frontal portion 31--

Col. 7, line 67 "curvatures" should be --curvature--

Col. 9, line 58 "wil" should be --will--

Col. 12, line 14 "machine" should be --machines--

Col. 12, line 57 "means at" should be --means remains at--

Col. 17, line 54 "webb" should be --web--

Signed and Sealed this

*Twenty-fifth* Day of *September 1979*

[SEAL]

*Attest:*

LUTRELLE F. PARKER

*Attesting Officer* *Acting Commissioner of Patents and Trademarks*